US005597348A

United States Patent [19]

Hutchins

[11] Patent Number: 5,597,348

[45] Date of Patent: Jan. 28, 1997

[54] WATER FEED FOR SANDING TOOL

[75] Inventor: Donald H. Hutchins, Sierra Madre, Calif.

[73] Assignee: Hutchins Manufacturing Company, Pasadena, Calif.

[21] Appl. No.: 346,905

[22] Filed: Nov. 29, 1994

[51] Int. Cl.[6] ..... B24B 23/00

[52] U.S. Cl. ..... 451/450; 451/357; 451/295

[58] Field of Search ..... 451/450, 488, 451/357, 344, 354, 295, 359

[56] References Cited

U.S. PATENT DOCUMENTS

| | | | |
|---|---|---|---|
| 1,698,970 | 1/1929 | Shaff | 451/450 |
| 3,110,993 | 11/1963 | Grage . | |
| 4,102,084 | 7/1978 | Bloomquist . | |
| 4,129,966 | 12/1978 | Smart et al. . | |
| 4,490,948 | 1/1985 | Hanstein et al. . | |
| 4,671,019 | 6/1987 | Hutchins . | |
| 5,022,190 | 6/1991 | Hutchins . | |

FOREIGN PATENT DOCUMENTS

| | | | |
|---|---|---|---|
| 6003174 | 1/1981 | Japan | 451/357 |
| 58-59765 | 5/1983 | Japan . | |

OTHER PUBLICATIONS

Pp. 24 and 25 of Feb. 1994 issue of "Chilton's Automotive Body Repair News".

*Primary Examiner*—Robert A. Rose
*Attorney, Agent, or Firm*—William P. Green

[57] ABSTRACT

A portable abrading or polishing tool including a tool body carrying an air motor which drives an abrading or polishing head relative to the tool body, with the tool including an aspirator energized by pressurized air for inducing a flow of water to a work surface, and with air being delivered from a source to the motor and the aspirator separately, so that the air passing through the aspirator and to the work surface does not first pass through the motor. A check valve prevents reverse flow of water from the aspirator to the motor when the supply of pressurized air is shut off, to thus prevent damage to the motor by the water. Means are provided for holding the check valve in closed condition even when air is supplied to the motor, to enable lubrication of the tool by air containing entrained lubricant without delivery of the lubricant to the aspirator or work surface.

16 Claims, 3 Drawing Sheets

WATER FEED FOR SANDING TOOL

This invention relates to portable power operated sanding tools.

BACKGROUND OF THE INVENTION

In performing a sanding operation, it is sometimes desirable to apply water to the surface being sanded in order to cool and lubricate that surface and carry away abraded particles. The water may be delivered to the work surface by a hose, spray, or the like, or may be introduced through the sanding tool itself. U.S. Pat. No. 5,022,190 issued Jun. 11, 1991 to Alma A. Hutchins shows a tool having a sanding head which is driven orbitally by a motor of the device, and by which a sheet of sandpaper is carried for engaging and acting on a work surface, with the head containing passages through which water is delivered to openings in the sandpaper for emission onto the work surface at the location of the sanding operation. In that patent, water is supplied to the tool through a hose connected to a pressurized source of the water. There have also been prior tools in which the exhaust air from a motor driving the tool has been utilized to induce a flow of water to the work surface by aspirator action. However, in these tools, the exhaust air intermixes with the water and is discharged onto the work surface with the water, and may contaminate the work surface if the air in flowing through the motor has picked up any dirt, lubricant, or other unwanted substances.

SUMMARY OF THE INVENTION

A major purpose of the present invention is to provide a sander which is capable of delivering water to the work surface without the necessity for an external pressurized source, and which can do so without the above discussed possibility of contaminating the water by prior passage of aspirating air through the motor of the device. In a tool embodying the invention, pressurized air is supplied to an air motor of the device from a source of such air in essentially conventional manner, and a second flow of air is also supplied from that source to an aspirator of the tool separately from the primary flow to the motor, and without passage of the secondary flow through the motor. The clean secondary flow of air is then utilized by the aspirator to induce a flow of water to the work surface.

A unique valve arrangement acts to prevent inadvertent reverse flow of water through the aspirator to the motor when the operation of the tool is stopped. In the absence of this valve structure, brief continued movement of the rotor or other internal mechanism of the motor after the supply of air to the motor is shut off may tend to draw water through the system into the motor and cause damage thereto. For this purpose, the valve mechanism may include a check valve interposed in a passage leading from the air source to the aspirator. When the sander is in operation, the pressurized air forces this check valve to an open condition allowing delivery of air to the aspirator. When the pressure of the air is cut off to stop the tool, the check valve moves to a closed position preventing reverse flow of air from the aspirator into the air supply passages and through those passages to the motor. Means are also provided for locking the check valve in closed condition when desired, in order to permit introduction of lubricant into the motor through the air system without flow of any of that lubricant to the water delivery passages. For this purpose, a threaded element may be manually actuable against the check valve to hold it in closed position.

BRIEF DESCRIPTION OF THE DRAWINGS

The above and other features and objects of the invention will be better understood from the following detailed description of the typical embodiment illustrated in the accompanying drawings in which.

DESCRIPTION OF THE PREFERRED EMBODIMENT

Figure 1:
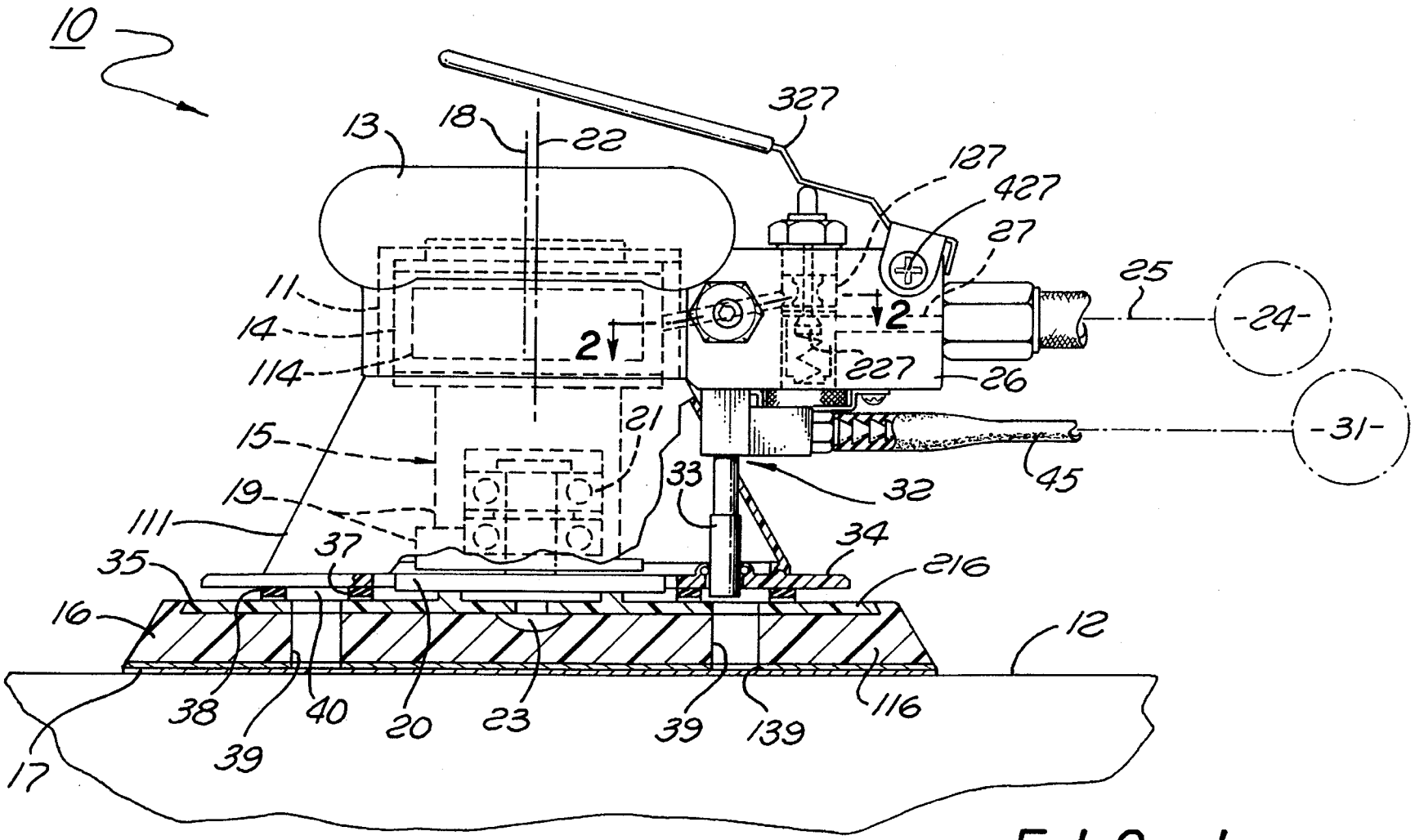
FIG. 1 is a side elevational view of a portable sander constructed in accordance with the invention.

The tool 10 shown in the drawings is an orbital sander having a body structure 11 which is shaped as a handle to be held by a user in manipulating the tool and moving it along a typically horizontal work surface 12 to sand or polish that surface. The upper side of the body 11 may be covered by a cushion 13 of rubber or other resiliently deformable material by which the tool is held. A rotary air driven motor 14 has a rotor 114 which is driven rotatively about a vertical axis 18 by compressed air. Motor 14 acts through an orbital drive connection 15 to move an abrading pad or head 16 and a carried sheet of sandpaper 17 orbitally about the vertical axis 18 of the motor to sand surface 12. The oribital drive connection 15 typically includes a part 19 driven rotatively about axis 18 by rotor 114 of motor 14 and a member 20 connected to member 19 by bearings 21 for rotation relative to member 19 about a second vertical axis 22 which is parallel to axis 18 but offset slightly therefrom to give member 20 its desired orbital movement about axis 18 as part 19 is driven rotatively by the motor. The sanding pad 16 is circular about axis 22, and includes a resiliently deformable circular cushion 116 carrying the sandpaper and an upper circular rigid backing plate 216 adhered to the cushion. Pad 16 is connected detachably to member 20 of the orbital drive connection, as by a screw represented at 23 in FIG. 1.

Air is supplied to motor 14 from a source 24 of compressed air through a line 25 connecting into a rearwardly projecting portion 26 of body 11 of the tool. From inlet line 25, the air flows through a passage 27 in portion 26 of the body leading to a vertical bore 127 containing a manually actuated valve 227 which is normally spring urged to closed position and is adapted to be opened by downward movement of an actuating handle 327 attached pivotally at 427 to portion 26 of body 11. Depression of handle 327 by a user admits air from passage 27 to a passage 28 leading to motor 14, thus commencing operation of the motor and orbital movement of sanding pad 16. Air is discharged from the motor through an outlet passage 29 exhausting to atmosphere.

Water is supplied to tool 10 from a water source 31 through a flexible hose 45 connected into an aspirator 32 projecting downwardly from the underside of portion 26 of body 11 of the tool. Water is discharged from the aspirator through a tube 33 which projects downwardly through an opening in an annular rigid horizontal member 34 connected rigidly to body 11 of the tool by attachment to the lower edge of a rigid downwardly flaring shroud 111 disposed about the orbital drive connection. The upper end of this shroud is attached in any convenient manner to body 11. The connection between the shroud and member 34 may be made by providing the lower end of the shroud with a circular internal rib 211 which is a snap fit within a circular external groove 311 formed in an annular upwardly projecting portion 411 of member 34. A seal ring 133 about tube 33 forms a seal between the tube and member 34.

Shroud 111 and member 34 are centered about axis 18, with member 34 being spaced slightly above and parallel to the upper horizontal surface 35 of the rigid backing plate 216 of pad 16. Two concentric circular seal rings 37 and 38, centered about axis 18 and adhesively attached to the horizontal undersurface of member 34 at its underside, engage upper surface 35 of backing plate 216 of pad 16 in fluid tight sealing relation to confine the water radially between these seal rings. A number of passages 39 formed in pad 16 and communicating with the space 40 between the seal rings conduct the water downwardly through the pad and through communicating openings 139 in the sandpaper sheet to the work surface 12.

Figure 2:
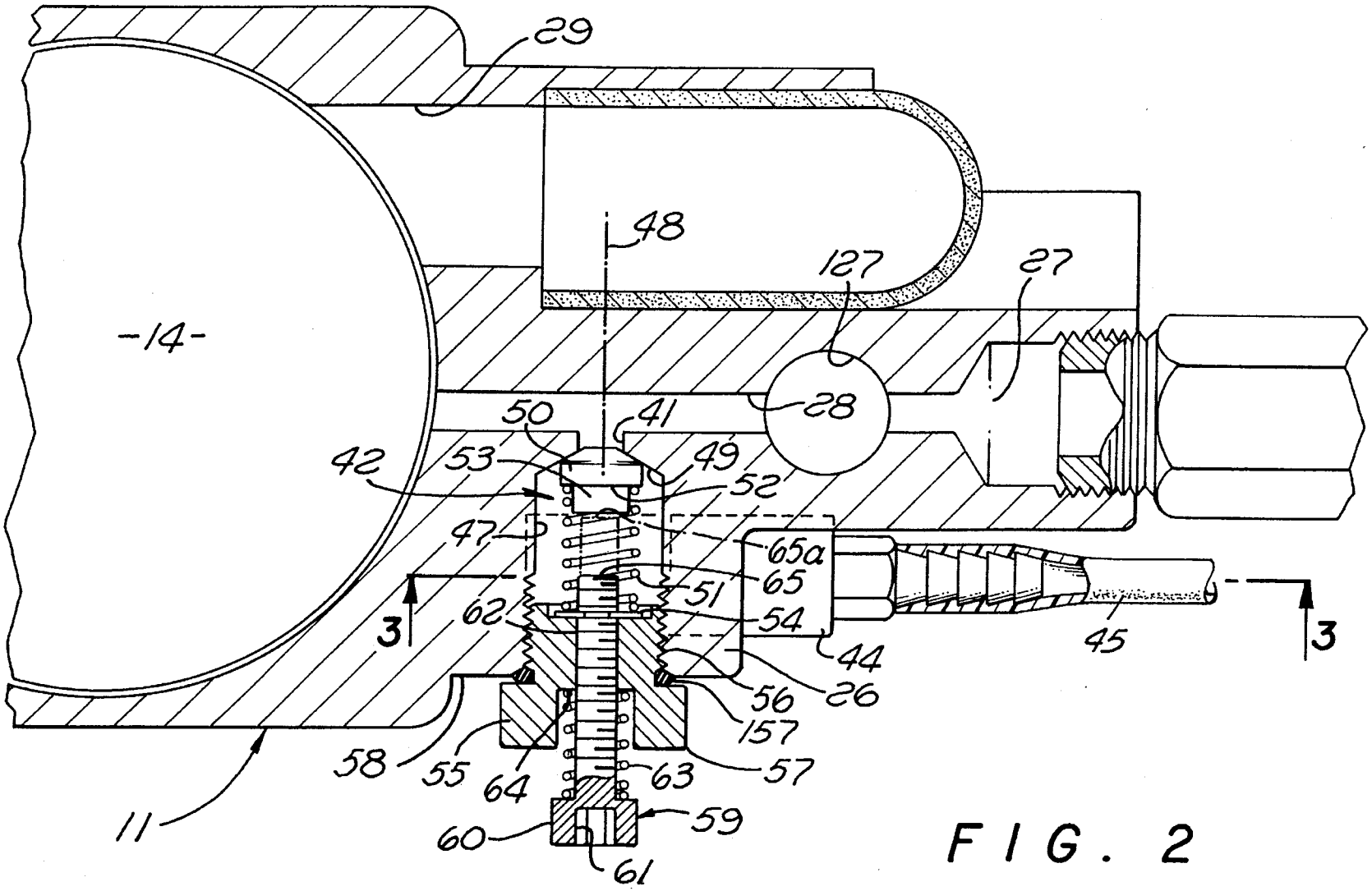
FIG. 2 is an enlarged fragmentary generally horizontal section taken on line 2—2 of FIG. 1.
Figure 3:
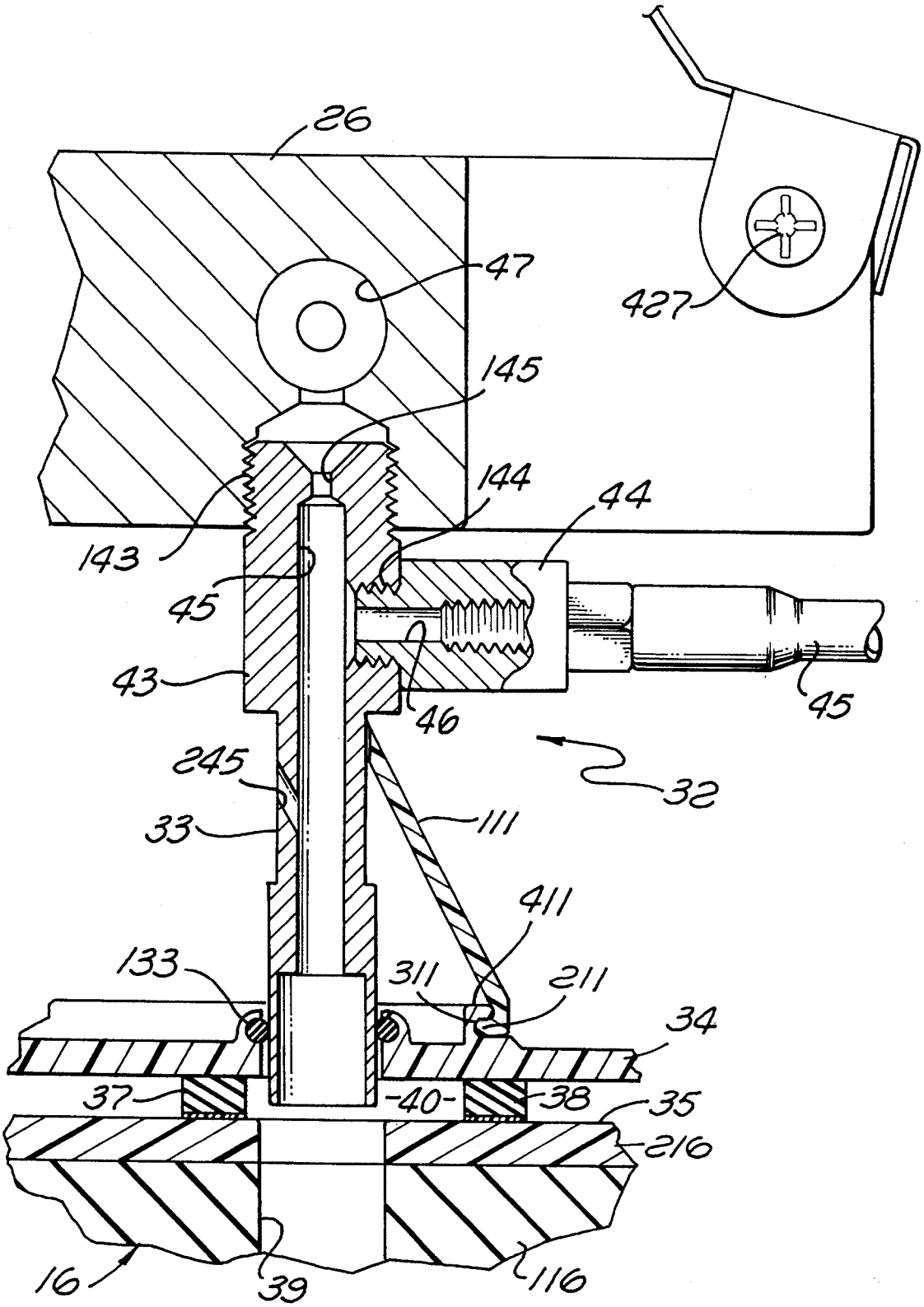
FIG. 3 is a fragmentary vertical section taken on line 3—3 of FIG. 2.

The flow of water to the pad is induced by a flow of air taken from passage 28 in the body through a branch passage 41 (FIG. 2) leading past a valve assembly 42 in a chamber 47 to the aspirator 32. As seen in FIG. 3, the aspirator includes a block 43 connected threadedly to the underside of portion 26 of body 11 at 143, and a second block 44 connected threadedly into a side of block 43 at 144. Pressurized air entering the aspirator from valve chamber 47 flows downwardly through a vertical passage 45 in block 43 and through tube 33 leading to space 40 between seal rings 37 and 38. The downwardly moving air acts by aspirator action to draw water from inlet line 45 through a passage 46 in block 44 into passage 45, to flow downwardly with the air into space 40 between seal rings 37 and 38. A restriction 145 in passage 45 acts to increase the velocity of the downward flow of air at the location of water inlet passage 46, to enhance the aspirator action. A small downwardly and inwardly inclined passage 245 may be provided in the side wall of tube 33 beneath block 43, to enable a small amount of air to be drawn into the tube through that passage from atmosphere and mix with the downwardly flowing air and water from the aspirator, to further enhance the aspirator action.

Referring again to FIG. 2, the branch passage 41 opens horizontally into valve chamber 47 in portion 26 of body 11. Chamber 47 may be cylindrical and centered about a horizontal axis 48, with the short passage 41 also preferably being centered about that axis, and with a tapering annular seat 49 being formed in portion 26 of the body at the juncture of chamber 47 and passage 41. Valve assembly 42 includes a check valve element 50 which may be formed of rubber or other resiliently deformable material, and which is yieldingly urged along axis 48 toward seat 49 to seal off the flow of air or water from chamber 47 back through passage 41 to the main air inlet passage 28.

A coil spring 51, also centered about axis 48, has one of its ends bearing against an annular shoulder 52 on valve element 50, and is disposed about a short cylindrical centering projection 53 on element 50, and has its opposite end bearing against an annular shoulder 54 on a part 55 connected threadedly at 56 into an end portion of chamber 47. An enlarged hexagonal head 57 on part 55 is tightenable against a seal ring 157 which bears against an outer planar surface 58 of portion 26 of body 11. The inter-engaging threads 56 of portion 26 and part 55 are centered about the previously mentioned horizontal axis 48 of the valve mechanism.

In addition to the parts thus far described, the valve assembly 42 also includes a screw 59 extending horizontally along axis 48 through the center of part 55 and having an enlarged head 60 at its outer end adapted to be turned by a tool, such as an allen wrench engageable with a hexagonal recess 61 in the head of the screw. Screw 59 has external threads centered about axis 48 and engaging internal threads within part 55 at 62, to enable axial adjustment of the screw by rotation relative to part 55. A coil spring 63 bearing in opposite direction against head 60 of screw 59 and an annular transverse shoulder 64 formed in part 55 acts to frictionally retain the screw in any desired set position.

During normal operation of the sander, the extremity 65 of screw 59 is spaced axially from valve element 50, and consequently does not interfere with movement of the valve element axially away from its seat 49 to allow the flow of pressurized air from passage 28 past valve element 50 into chamber 47. The screw can, however, be actuated to a position in which it positively prevents opening of valve element 50, in order to permit lubrication of the tool by admission of lubricant into the flow of air to the motor without bypassing any of that lubricant to the aspirator and sanding pad 16. To attain such positive closure of valve element 50, the screw is rotated by an allen wrench to a position in which the extremity 65 of the screw engages the end of cylindrical projection 53 on valve element 50 and holds that valve element closed. This position of the screw is represented in broken lines at **65*a* in FIG. 2**.

In performing a sanding operation with the tool 10 shown in the figures, a user first applies the sheet of sandpaper 17 to the underside of the cushioned head 16 of the tool, with the sandpaper typically being held in place by adhesive, and with the openings 139 in the sandpaper communicating with the water delivery passages 39 in head 16 to conduct water to the work surface 12. With the compressed air source 24 and water source 31 connected to the tool, an operator places the tool on the work surface as shown in FIG. 1, and presses downwardly on valve actuating element 327 while holding the body 11 of the tool by engagement with the cushion 13 covering the top of the body. Depression of element 327 acts to open valve 227 and admit the flow of pressurized air through passage 28 to the motor to commence rotation of the motor and orbital movement of pad 16 and the sandpaper sheet 17. Assuming that screw 62 has been backed off to the position illustrated in full lines in FIG. 2, the pressurized air in passage 28 acts to force valve 50 away from its seat 49 and to an open position permitting the flow of air through passage 41, past the valve, and through chamber 47 to aspirator 32. The downward flow of air through the aspirator induces a corresponding flow of water from inlet line 45 downwardly through tube 33 into the space vertically between member 34 and the upper surface of pad 16, and radially between the two seal rings 37 and 38. From that confined annular space, the water can only flow downwardly through passages 39 in the sanding head and through openings 139 in the sandpaper sheet 17 to the work surface.

When the operator wishes to stop the operation of the tool, he allows valve actuating element 327 to be moved upwardly by the force of the spring pressed normally closed valve 227, thus closing that valve and stopping the flow of air into inlet passage 28 to the motor. At the same time, the reduction in the pressure of the air within passage 28 permits valve 50 to move into engagement with its seat 49 under the influence of spring 51, thus preventing the flow of air or water from the aspirator or chamber 47 back through branch passage 41 into passage 28 leading to the motor. After the delivery of compressed air to the motor is shut off, there is a tendency for the rotor of the motor to continue rotation for a short period of time by momentum. If the check valve element 50 were not present in the system, that continued rotation of the motor would tend to pump air and water in a reverse direction from aspirator 32 through chamber 47 and passage 41 into passage 28 leading to the motor. Any water thus drawn to the motor would tend to damage the motor and its interior parts and detract from the effective life of the tool. Check valve 50 thus acts as a safety protecting the interior of the motor from contact with water.

When it is desired to lubricate the tool, this may be done by introducing lubricant into the flow of air from source 24 through inlet line 25 to the tool, so that oil or other lubricant thus entrained in the air can flow through the motor and lubricate its rotor and other moving parts. In order to prevent any of the lubricant from flowing past valve 50 to the aspirator, the screw 62 is adjusted to its broken line position 65*a* of FIG. 2 and maintained in that position during the lubricating procedure. The screw then holds check valve 50 in closed position, preventing it from opening when pressurized air is admitted into passage 28 in the tool, and thereby isolating the aspirator and sanding head from any contact with the lubricant.

While a certain specific embodiment of the present invention has been disclosed as typical, the invention is not limited to this particular form, but rather is applicable broadly to all such variations as fall within the scope of the appended claims.

I claim:

1. A portable abrading or polishing tool, comprising:

a tool body to be held and manipulated by a user;

a motor carried by said body and driven by pressurized air;

a head movable relative to said body by said motor and adapted to carry an element for abrading or polishing a work surface;

a water inlet;

an aspirator energized by pressurized air to induce a flow of water from said inlet to the work surface near said head;

means for delivering a first flow of air from a source to and through said motor to drive it and for delivering a second flow of air separately from said source to said aspirator, to induce a flow of water to the work surface, without passage of said second flow of air through the motor; and valve means acting when air is not being supplied from said source to said motor or aspirator to prevent flow of water from said inlet into the motor.

2. A portable abrading or polishing tool as recited in claim 1, including a manually actuated valve unit for controlling both said first flow of air and said second flow of air and actuable between an open condition passing air to both the motor and aspirator and a closed condition preventing flow of air to either the motor or the aspirator.

3. A portable abrading or polishing tool as recited in claim 1, in which said means include a manually operated valve unit actuable between an open position for admitting air from said source to both the motor and aspirator and a closed condition preventing flow of air to either the motor or aspirator, passage means for delivering said first flow of air from said valve unit to the motor, and branch passage means for delivering said second flow of air to the aspirator.

4. A portable abrading or polishing tool, comprising:

a tool body to be held and manipulated by a user;

a motor carried by said body and driven by pressurized air;

a head movable relative to said body by said motor and adapted to carry an element for abrading or polishing a work surface;

a water inlet;

an aspirator energized by pressurized air to induce a flow of water from said inlet to the work surface near said head;

means for delivering a first flow of air from a source to and through said motor to drive it and for delivering a second flow of air separately from said source to said aspirator, to induce a flow of water to the work surface, without passage of said second flow of air through the motor; and a check valve acting to pass air from said source to said aspirator during operation of said motor and operable to prevent reverse flow of water from said inlet or aspirator past the check valve to said motor when the motor is not being driven by air from said source.

5. A portable abrading or polishing tool as recited in claim 4, including means for holding said check valve in closed position preventing flow of air from said source to said aspirator even though pressurized air is supplied to the motor from said source.

6. A portable abrading or polishing tool, comprising:

a tool body to be held and manipulated by a user;

a motor carried by said body and driven by pressurized air;

a head movable relative to said body by said motor and adapted to carry an element for abrading or polishing a work surface;

a water inlet;

an aspirator energized by pressurized air to induce a flow of water from said inlet to the work surface near said head;

means for delivering a first flow of air from a source to and through said motor to drive it and for delivering a second flow of air separately from said source to said aspirator, to induce a flow of water to the work surface, without passage of said second flow of air through the motor;

said means including a manually operated valve unit actuable between an open position for admitting air from said source to both the motor and aspirator and a closed condition preventing flow of air to either the motor or aspirator, passage means for delivering said first flow of air from said valve unit to the motor, and branch passage means for delivering said second flow of air to the aspirator; and a check valve in said branch passage means permitting flow of air from said valve unit to the aspirator but preventing reverse flow of air or water through said branch passage means to said first mentioned passage means leading to the motor.

7. A portable abrading or polishing tool as recited in claim 6, including a spring yieldingly urging said check valve to a closed position.

8. A portable abrading or polishing tool as recited in claim 6, including means for holding said check valve in closed position even though pressurized air is present in said first mentioned passage means.

9. A portable abrading or polishing tool, comprising:

a tool body to be held and manipulated by a user;

a motor carried by said body and driven by pressurized air;

a head movable relative to said body by said motor and adapted to carry an element for abrading or polishing a work surface;

a water inlet;

an aspirator energized by pressurized air to induce a flow of water from said inlet to the work surface near said head;

means for delivering a first flow of air from a source to and through said motor to drive it and for delivering a second flow of air separately from said source to said aspirator, to induce a flow of water to the work surface, without passage of said second flow of air through the motor;

said means including a manually operated valve unit actuable between an open position for admitting air from said source to both the motor and aspirator and a closed condition preventing flow of air to either the motor or aspirator, passage means for delivering said first flow of air from said valve unit to the motor, and branch passage means for delivering said second flow of air to the aspirator;

a check valve operable to pass air through said branch passage means to the aspirator but prevent reverse flow of water or air from the aspirator toward said first mentioned passage means; and an element threadedly adjustable between a position permitting opening of said check valve and a position holding said check valve in closed condition.

10. A portable abrading or polishing tool, comprising:

a tool body to be held and manipulated by a user;

a motor carried by said body and driven by pressurized air;

a head movable relative to said body by said motor and adapted to carry an element for abrading or polishing a work surface;

a water inlet;

an aspirator energized by pressurized air to induce a flow of water from said inlet to the work surface near said head;

means for delivering a first flow of air from a source to and through said motor to drive it and for delivering a second flow of air separately from said source to said aspirator, to induce a flow of water to the work surface, without passage of said second flow of air through the motor;

said means including a manually operated valve unit actuable between an open position for admitting air from said source to both the motor and aspirator and a closed condition preventing flow of air to either the motor or aspirator, passage means for delivering said first flow of air from said valve unit to the motor, and branch passage means for delivering said second flow of air to the aspirator;

a check valve operable to pass air through said branch passage means to the aspirator but prevent reverse flow of water or air from the aspirator toward said first mentioned passage means;

a coil spring yieldingly urging said check valve along an axis to a closed position; and a screw mounted for threaded adjustment and extending essentially along said axis within said spring and operable to tighten said check valve in closed condition.

11. A portable abrading or polishing tool as recited in claim 10, in which said tool body has a recess containing said check valve and said spring, there being a plug threadedly connected into said recess and acting against said spring to urge the check valve to its closed position, said screw being threadedly connected to a central portion of said plug and extending therethrough for threaded adjustment relative to the plug to hold the check valve in closed position.

12. A portable abrading or polishing tool as recited in claim 11, including an additional coil spring disposed about said screw and acting in opposite directions against a head of the screw and said plug.

13. A portable abrading or polishing tool as recited in claim 1, in which said head is driven about an axis relative to said body and contains passage means for receiving water from said aspirator and delivering it to said surface through the head;

there being a member carried by said body near said head and relative to which said head moves when driven by the motor; and two seals extending about said axis between said member and said relatively movable head and which are radially inwardly and outwardly of said passage means in the head and prevent escape of water between said member and head.

14. A portable abrading or polishing tool as recited in claim 1, in which said head contains passage means for receiving water from said aspirator and delivering it to said surface through the head.

15. A portable abrading or polishing tool as recited in claim 1, in which said head is driven by the motor orbitally about an axis relative to said body and contains passage means for receiving water from said aspirator and delivering it to said surface through the head.

16. A portable abrading or polishing tool as recited in claim 9, in which said head contains passage means for receiving water from said aspirator and delivering it to said surface through the head.

* * * * *